US005266250A

United States Patent [19]

Kroyer

[11] Patent Number: 5,266,250

[45] Date of Patent: Nov. 30, 1993

[54] METHOD OF MODIFYING CELLULOSIC WOOD FIBERS AND USING SAID FIBERS FOR PRODUCING FIBROUS PRODUCTS

[76] Inventor: Karl K. K. Kroyer, Le Vieux Moulin, 12 rue de la Liberation, 06520, Magagnosc, France

[21] Appl. No.: 747,493

[22] Filed: Aug. 19, 1991

Related U.S. Application Data

[63] Continuation of Ser. No. 520,828, May 9, 1990, abandoned.

[51] Int. Cl.[5] ..... D04H 01/64

[52] U.S. Cl. ..... 264/45.300; 264/51; 264/121; 264/128

[58] Field of Search ..... 264/109, 121, 128, 518, 264/123, 45.3, 45.8, 51; 425/83.1; 106/162, 163.1; 162/157.1, 157.4, 176, 179; 427/180

[56] References Cited

U.S. PATENT DOCUMENTS

| | | | |
|---|---|---|---|
| 3,575,749 | 4/1971 | Kroyer | 425/504 |
| 3,669,778 | 6/1972 | Rasmussen et al. | 156/62.2 |
| 3,674,896 | 7/1972 | Purcell et al. | 156/334 |
| 3,768,118 | 10/1973 | Ruffi et al. | 264/511 |
| 3,904,791 | 9/1975 | Iverson et al. | 427/277 |
| 3,963,819 | 6/1976 | Kroyer et al. | 264/128 |
| 4,111,744 | 9/1978 | Reihiger | 264/123 |
| 4,292,271 | 9/1981 | Buob et al. | 264/128 |
| 4,328,136 | 5/1982 | Blount | 106/162 |
| 4,336,299 | 6/1982 | Holst et al. | 264/122 |
| 4,417,931 | 11/1983 | Li | 264/128 |
| 4,420,368 | 12/1983 | Drach | 162/168.2 |
| 4,425,126 | 1/1984 | Butterworth et al. | 264/128 |
| 4,426,470 | 1/1984 | Wossling et al. | 264/128 |
| 4,494,278 | 1/1985 | Kroyer et al. | 19/304 |

*Primary Examiner*—Jay H. Woo
*Assistant Examiner*—Robert B. Davis
*Attorney, Agent, or Firm*—Watson, Cole, Grindle & Watson

[57] ABSTRACT

A method is provided of producing fibrous product from cellulosic wood fiber. First, a layer of this fiber material is deposited on a moving wire. A binding agent in an aqueous solution is then added to the fiber material. Next, the fiber material is moved through a superheated oven having a minimal amount of moving air to cause a lively boiling of the aqueous solution. The fiber material is then dried. In one embodiment, a mixture of alkali treated and acid treated fiber material is deposited on the moving wire.

29 Claims, 1 Drawing Sheet

METHOD OF MODIFYING CELLULOSIC WOOD FIBERS AND USING SAID FIBERS FOR PRODUCING FIBROUS PRODUCTS

This application is a continuation of application Ser. No. 520,828, filed May 9, 1990 now abandoned.

INTRODUCTION

The Kroyer unified fiber material for air laying of non-wovens, tissues and ordinary papers.

Cotton and wood fibers are the basis for the textile, non-woven and paper industries.

In 1850 the English inventor John Mercer was granted an important patent. He had developed a process improving the strength of cotton fibers. His invention was named after him: MERCERIZATION.

Mercerization provides cotton fibers with a considerable gain in tensile strength—this has been well known to the cotton industry for many years. Mercerization not only increases the tensile strength of cotton fibers, additionally it also improves the elasticity of the cotton fibers and their fabrics.

Mercerization of cotton is today so widely used that it could be said that most cotton fabrics are made of mercerized cotton fibers.

Cotton fibers are originally flat and ribbon-like, however, they swell during the mercerization process to become hollow. The mercerization is a physical transition of the cotton fibers from a flat form to an almost cylindrical form giving improved strength and elasticity to the fibers.

Five years of work at the KROYER Air-Forming Laboratory and Pilot Plants on cellulosic wood fibers has, through several thousand laboratory samples, resulted in a new process which has points of resemblance with mercerization of cotton.

However, the new KROYER cellulosic wood fiber process is different.

The KROYER invention reduces the cost of a fiber product, since the cellulosic wood fibers themselves, to a great extent, participate in a unique method of binding fibers together. This is a reduction of the cost of producing tissues, ordinary papers and "non-wovens".

The cellulosic wood fibers are not changed into synthetic fibers, however, an easily-made modification of the surface of the cellulosic wood fibers leads to production of a final fabric based upon an adhesive reaction between these modified cellulosic wood fibers. The fiber felt formed from these modified fibers can be calendered, embossed or creped since such modified fibers do not exclude hydrogen bonding for production of traditional products.

The changing of the surfaces of cellulosic wood fibers according to KROYER can modify cellulosic wood fibers to a higher or lower degree of Kroyerization depending on the end product wanted.

The end product is washable or disposable—depending on the extent to which the invention is used.

It is important to note that the amount of residue in the final product is minimized resulting in an end product having a higher percentage of pure cellulosic wood fibers than traditionally.

The new KROYER Invention might outdate many raw materials within the synthetic fiber area, especially the sort now used for non-wovens. Or maybe in future the expression "non-wovens" should include products made mainly or only from modified cellulosic wood fibers.

The five years' development in Kroyer Air-Laid has through said production of several thousand laboratory and pilot plant samples resulted in the invention explained on the following pages.

BACKGROUND OF THE INVENTION

The present invention relates to a method for producing fibrous products. More particularly, the present invention relates to a method whereby a superheated zone is utilized to promote bubbling of an aqueous binder solution, added to a fiber felt prior to drying, thus reducing the quantity of binder materials required to manufacture or improve the quality of the fibrous products.

The invention also relates to the combination of a superheated zone and a pretreatment of a certain percentage of the cellulosic wood pulp with a weak alkali containing water and a treatment of another percentage of the cellulosic wood pulp with a weak acid containing water to transform the surfaces of the fibers so as to obtain two different sorts of surfaces of the cellulosic wood fibers—seemingly unchanged—however, adhering to become unified under pressure, heat and moisture.

According to the invention the above mentioned alteration of cellulosic wood fibers, combined with the use of the superheated zone and combined with embossing, calendering or creping to produce a fibrous product, makes conventional pre-beating of wood cellulosic fibers superfluous for many products, since this strength-weakening beating becomes surprisingly unnecessary for many products.

The invention also concerns a fibrous product, produced in accordance with the invention, where the surfaces of two different quantities of cellulosic wood fibers are turned into invisibly "alkalinized" respective —acetated" fibers thus creating—in the fibrous end product—a two-component Ph-neutral bond.

The term cellulosic fibrous products comprises products such as wipers, kitchen paper, writing paper and toilet paper, diapers, table cloth, napkins, tissues, facial-tissues and various other products ranging from 30 grams to more than 200 grams per square meter.

During the last decades, the method of air-forming of fibers to produce paper products and non-wovens, facial tissues, toilet paper etc. etc. was developed.

one of the so-called Kroyer-Methods is especially explained in U.S. Pat. No. 4,494,278 (combined fiber distributors). The Kroyer-Methods also comprise the use of hammermills together the Drum Formers which have a perforated rounded bottom and some inside moving parts (Kroyer Know-How and a.o. Canadian Patent No. 868,142).

The Air-Forming Method solves not only pollution problems and saves energy, it also makes it possible to produce soft and absorbent products and non-wovens having a more textile-like character than usual.

The Air-Forming Method is not limited to soft products such as tissues and non-wovens. Also products which are much more stiff in character, such as packaging material, different sorts of board and any of various high-pressure laminated plastic sheets of melamine and phenolic materials known as FORMICA ®, have been made industrially.

Many products, after they have been air-formed, are sprayed with an emulsion, which is often a latex emulsion, used as a binder material. It is not unusual that the emulsion to be added to the fiber felt contains 10% by weight to 20% by weight of the dried substance in the end product.

Accordingly, it would be desirable to produce fibrous products such as those described above with acceptable strength but requiring a much smaller quantity of binder material.

The problems referred to above are not exhaustive but are among those which reduce the number of advantages of the prior methods of producing fibrous products.

Other noteworthy problems may also exist, however, those presented above should be sufficient to demonstrate that fibrous product methods, here in the prior art, have not been altogether satisfactory as regards quality. Products with such a high content of binder as from 10% to 20% dry substance (which is much more expensive than cellulosic wood fibers) are unnecessarily costly to produce.

OBJECTS OF THE INVENTION

It is, therefore, a general object of the invention to provide a method for producing fibers which are able to produce products, improve the quality of products previously described and reduce the production cost of said products.

It is a particular object of the invention to provide a method and apparatus for producing fibrous products of improved quality and performance.

It is another object of the invention to provide a method and apparatus for producing fibrous products which require a substantially reduced amount of binder material.

It is another object of the present invention to provide a method and apparatus for producing fibrous products of improved tensile strength, hand and feel.

It is still another object of the present invention to provide a method and apparatus for producing fibrous products which minimize fiber losses.

It is yet a further object of the present invention to provide a method and apparatus for producing fibrous products which permit the application of a thinner binder solution to the fibrous felt.

It is still a further object of the present invention to provide a method and apparatus for producing fibrous products at a reduced total raw material cost.

It is yet still a further object of the present invention to provide a method and apparatus for producing fibrous products which utilize cellulosic wood pulp, where one portion has been prepared with small amounts of acid and another portion with small amounts of alkali to promote fiber binding on the fiber surfaces.

It is yet still a further object of the present invention to provide a method and apparatus for producing fibrous products which utilize a finely powdered thermoplastic compound and distribute such a thermoplastic powder onto the product, thus more or less closing the surface for special products.

It is a further object of the present invention to provide a method and apparatus for producing fibrous products which utilize an effervescent method to perfect the vertical distribution of the binders in the product after the formation of the fiber felt, thus making it superfluous to apply binder to both sides of the product.

It is yet a further object of the present invention to provide a method and apparatus for producing fibrous products which combine and distribute special binder agents to promote fiber binding by polymerization.

SUMMARY OF THE INVENTION

One preferred embodiment of the invention which is intended to accomplish at least some of the foregoing objects, comprises a method of producing fibrous products from cellulosic wood fibers by the following steps: depositing a layer of defibrated cellulosic wood fiber material on a moving wire, adding to the fiber felt a relatively small amount of binding agent in a watery suspension or solution, moving the fibrous material through a superheated oven with little or no air through or along the product to cause a lively boiling of the aqueous binder in the fibrous sheet and thereafter, drying the sheet in a conventional dryer.

In still another embodiment, the present invention comprises the formation of a fibrous product from a portion of cellulosic wood pulp prepared with a relatively small amount of alkali, and another portion of cellulosic wood pulp prepared with a relatively small amount of acid. The two different modified cellulosic wood fiber portions are thereafter totally mixed in a Kroyer hammermill and in a subsequent Kroyer air-forming head. The embodiment also comprises a superheated oven having heating means, an inlet and an outlet to a conventional dryer in succession of the superheated oven. In the superheated oven there is little or no air flow.

BRIEF DESCRIPTION OF THE DRAWINGS

Drawing No 1 illustrates the ideal use of a binder according to the invention. The binder is withdrawn to the cross-linking points of the cellulosic wood fibers which are important for the final products.

Drawing No 2A illustrates a normal air-forming distribution of the fibers in all positions. The drawing No 2B also illustrates the same fibers, however, with the bubbling binder-emulsion boiling up in the superheated oven to distribute the emulsion vertically through the product.

DETAILED DESCRIPTION OF THE INVENTION

Figure 1:
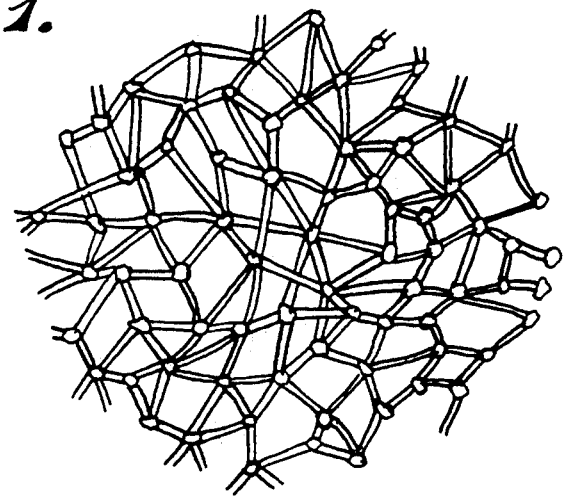
Figure 2A:
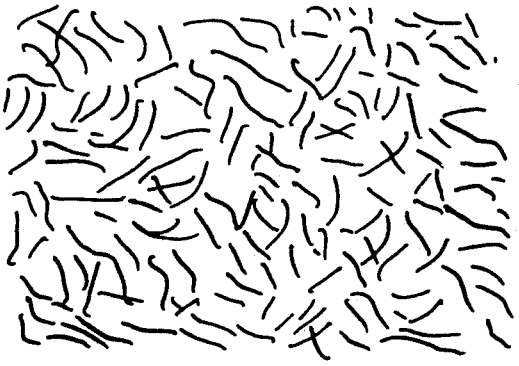
Figure 2B:
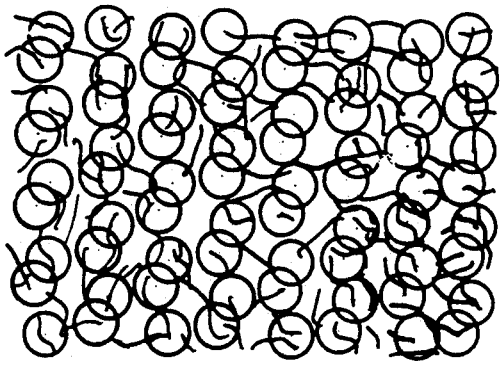

The present invention, in which a superheated oven and/or the addition of chemical agents is utilized to reduce the amount of binder material in fibrous products, will now be described in detail. As noted previously, however, the present invention could be used in any of the various methods of forming fibrous products and is not specifically restricted to paper making.

The fibrous sheet material wetted by the aqueous binder is passed to a superheated oven, for instance heated with infrared elements. The sheet is passed through the superheated oven, practically preventing airflow through or along the fibrous product.

Any means for producing heat in said oven, with little or no airflow through or along the sheet wetted with aqueous binder, may be used.

It is in the superheated oven that lively bubbling of the aqueous binder occurs in the fibrous product.

Directly from the superheated oven, the fibrous material passes through a dryer which removes all or part of the moisture from the fibrous material. From a conventional dryer, the substantially dehydrated or partly wet fibrous material can, for conventional paper products, pass through a calender stack which comprises a series of smooth and heated calender rolls or pass to a Yankee cylinder for drying of board products—or to a conventional creping unit to produce toilet papers or other tissues.

Conventional dryers are used for the absorbent type of cellulosic products, with or without an embossed pattern, like wipers, kitchen paper, or diapers, where the binder in a water-emulsion-form, such as for instance heat-curable latex or other binders, is applied to both surfaces of the product to be dried.

As noted above, the process of the present invention includes a superheated oven followed by a drying section. The drying section may be of the conventional type known to those skilled in the art. In definitive contrast to the superheated oven of the present invention, most conventional dryers for air permeable products are of the "high-velocity, forced-hot-air, circulation-type", wherein heated air is passed through the product. Consequently boiling up and bubbling does not occur during the drying of the fibrous product in conventional dryers.

This fact might be a surprise to many users of such conventional dryers.

In continuation of a conventional dryer it is not uncommon to include an end sector where stabilization, e.g. curing, crosslinking, polymerization or vulcanization, takes place.

Other conventional dryers have a finishing sector which comprises a cylinder or cylinders which finish the evaporation and consolidate or crepe the fibrous products.

In sharp distinction to the system described in the prior art, in the process of the present invention a superheated zone, in which air circulation is minimized and which functions as an oven, is maintained at an elevated temperature prior to or at the beginning of a conventional dryer. Unlike a conventional dryer, however, the superheated oven is not intended to remove a major part of the water from the aqueous binder applied to the product. Instead, the superheated oven is utilized to cause foaming bubbles by an instant boiling up of the water-thinned binder in the fibrous product so that the aqueous binder expand in the product. In this connection, in the superheated oven, there is no forced airflow and substantially no airflow through the fibrous product or along the fibrous product. Accordingly, the heat applied to the fibrous product in the superheated oven causes instant boiling of the binder solution, resulting in bubbling and foaming of the aqueous binder vertically through the fiber sheet.

The sudden vigorous bubbling in the fibrous product, as the product is carried through the superheated oven, produces physical and chemical reactions including bursting and later disappearance of the binder bubbles created. This lively boiling in the product accelerates physical and chemical processes which positively influence the quality of the fibrous product, and reduce the costs to produce the fibrous product by sharply reducing the amount of binder required in a given material. Accordingly, binders may be utilized in a much more profitable way than in the prior art.

The significant increase in the uniformity of distribution of binder through the fiber sheet which results from bubbling in the product in the superheated oven has been found not only to save binder, but also to prevent delamination, which is of great importance for products made of short fibers such as cellulosic wood fibers. Prevention of delamination is believed to be also important for products made of man-made fibers mixed with wood or cotton fibers.

A further significant advantage in accordance with this invention is that the aqueous binder can be applied in a thinner solution than conventionally used in the paper industry for wood cellulosic products. For instance, if a latex-emulsion is used, such latex-emulsion will often be sprayed onto the product in an amount so that the final product has a dry substance of from 15% by weight to 20% by weight of binder. However, according to the present invention, the effect of the superheated oven preceding a drying section results for a product with a comparable wet and dry tensile strength in a requirement of only 2% by weight to 6% by weight dry binder substance, preferably 3% to 4%; in the emulsion to be sprayed on—or otherwise applied to the fibrous product.

Still a further advantage of the present invention is that the total water content to be evaporated might be decreased.

The superheated oven is preferably maintained at high temperature by heat radiation or heat conduction instead of by forced hot air. Air velocity through the fibrous material is minimized in the superheated oven by preventing air from passing through the carrying device, which is often a sieve or a perforated plate. The blockage of the air through the fibrous product is preferably accomplished underneath the product transporting plate such as by means of a heated unperforated plate or closely packed heating tubes or infrared heat. Above the fibrous product a second heat source, preferably formed as a box or a battery of heat tubes, is positioned. In addition, if a further reduction in air passing through or along the fibrous product is desired, the lower and/or upper heat source can be moved in the direction of travel of the fibrous material in the oven.

Depending upon the particular fibrous product to be produced, the superheated oven may have a length of from 5% by weight to 10% by weight of the total length of the dryer. In the superheated oven a temperature exceeding 200° C. or even 300° C. is preferred to stimulate the boiling, the bubbling, the foaming and the bursting of binder bubbles. The travel of the product in the superheated oven may extend boiling from a fraction of a second to several seconds, depending on the thickness of the product and the binder and water content of the product carried through the superheated oven. Nevertheless, the length of the oven and the temperature in the oven in combination, are sufficient to cause substantially instantaneous bubbling and foaming of the aqueous binder.

As noted above, the superheated oven causes the aqueous binders, applied previously to the fibrous product, to boil and foam. When the bubbles have been formed in the superheated oven, causing non-connecting pores, they afterwards burst and shrink under the temporary or stationary physical form of a skeleton, now having connected pores. Although the effect is not completely understood, it is a fact that the successively more viscous binder—created after bubbling, bursting and shrinking—under the evaporation-shrinkage draws fibers and fiber ends together, thus making firm crossing joints. If the fibers are fibrillated, some fibrils are drawn into the respective fibers and other fibrils to other fibers and other fibrils finally producing a more or less interlocking there-dimensional structure of the fibrous product. This is an enhanced form of binding a fibrous product, whereby the binder links the fibers and their fibrils where they cross each other, preventing an unwanted and costly gluing all over the fibers in a fibrous product, which is the result of some conventional methods.

In addition, since cellulosic fibers are hollow and tube-shaped, and since a cellulosic fiber is believed to consist of amorphous, misaligned, weak, porous fiber regions between stronger parts being crystalline and non-porous, the process of the present invention also utilizes the above-mentioned diluted binder material to boil into the fibers themselves in the superheated oven. It is believed that as the water-thinned in and out of the weak amorphous part of the hollow cellulosic in and out of the weak amorphous part of the hollow cellulosic fibers. During further evaporation the binder is believed to partly leave the inside tube of the fibers, through reparation strengthening the amorphous weak parts of the tubular fibers, thus leaving each fiber, and thereby the fibrous product, stronger than before, Accordingly, using the method of the present invention a strong, absorbent, high quality fibrous product is produced having fibers which are bonded with crossing fibers and fibrils as the result of burst binder bubbles formed in the superheated oven. The shrinkage, the contraction of the extraordinary waterdiluted binder, under such circumstances is more than 90% by weight until the residuum, that is the binder itself, has shrunk making joints in the crossing points of fibers and fibrils during bubbling, bursting and withdrawal.

The invention is especially useful for products made of fibers such as cellulosic wood fibers with or without fibrils, that is beaten wood pulp as used in the paper industry. The invention is applicable for cellulosic cotton fibers and cotton linters. The invention is also useful and advantageous for sheet-formed fibrous products like so-called non-wovens and diapers and filter materials.

A hot or wet-embossing with 20% by weight to 30% by weight humidity and a temperature above 100° C., and preferably above 200° C., may be accomplished by means of engraved calender rolls. This procedure results in a beating of the fibers in the lines where the embossing is made. This makes it possible to form hydrogen bonds using non-beaten fibers without previous mechanically or chemically produced fibrils. The ability to include embossed lines or points in a fibrous product, is used for instance for wipers, kitchen papers, or diapers and is significant since it is thereby possible to have small pillows or other areas of a few square millimeters in size between the lines or points in such an embossed product. Reference is made to the Kroyer U.S. Pat. No. 3,669,778.

The non-embossed areas, the pillows, are bound together according to the invention described, with the embossed lines obtaining hydrogen bond strength through the hot wet 20% by weight to 30% by weight embossing process. The combination of the hot humid-embossing, the bubbling waterous binders in the superheated oven and the bubble-bursting mentioned above is especially valuable for a product in which non-embossed pillows are required to retain the absorbent character of natural wood fibers, and where the binder used in accordance with the invention serves to strengthen the hydrogen bond in the embossed part of absorbent fiber products. Such fiber products are often used wet. In an embossed product according to said U.S. Pat. No. 3,669,778 there is a combination of strength lines with good water-resistant bonds and small pillows, which have their fibers treated to prevent fiber losses, according to the present invention.

It is frequently necessary to prevent excessive fiber losses since, for hygienic reasons, fiber loses are not wanted, for example, by surgeons in hospitals, nor in the kitchen, nor for sanitary protection for ladies and babies. Loose fibers are undesirable for pocket handkerchiefs. A fibrous product, bonded according to the invention, can eliminate this problem. A further method of closing the cellulosic fibers in an absorbent product concerns the application of a thermoplastic binder powder to the surface of products made in accordance with the invention. Such a thermoplastic powder might be applied to the surface while the product is under vacuum before it is heated—this is possible when the powder is added to the last section of the forming head—the last section in the combined fiber distributor air-forming system in accordance with the Kroyer U.S. Pat. No. 4,494,278. Synthetic fiber coated cellulosic fiber products are very difficult or impossible to get rid of by disposal, however, often used.

In yet another aspect, the present invention provides a method of accelerating and/or enhancing the binding which occurs in the superheated oven. As mentioned previously, cellulosic fibers are known to be tube-shaped. However, the tubes are normally flat or nearly flat. In this regard, various alkaline ingredients in diminutive amounts, for instance ammonium carbonate, but also acids such as small amounts of diluted acetic acid, vinegar (both products often used in household) have the ability to improve the fiberform. In fact, very mild treatment of the fibers with alkali or acid results in a degree of what could be called mercerization or acetation, although the effect is not that the fibers are dissolved—quite the contrary—the quality of each treated fiber is improved.

It is well known that mercerized cotton has improved strength over non-mercerized cotton, and that rayon has improved wet and dry strength over cellulosic wood fibers, which is often the raw material for rayon. However, by the method of the present invention, it is possible to produce mercerized cellulosic wood fibers, and/or to produce a very low percentage of rayon or acetate on the surface of the cellulosic wood fibers, and at the same time make the fibers swell, make the tube-form more round and thereby ease the above-mentioned strengthening of the amorphous weak places of the fibers by utilizing the effect of the superheated oven's bubbling-up of the thinned aqueous binder. In this connection, fibers which have been made round through alkaline swelling treatment may then be reinforced by the effect of the superheated oven which causes binder to be placed where the fibers cross, and in the amorphous weak places of fibers. The products may be adjusted to a desired pH by adding to the aqueous binder a neutralizing agent, or preferably the slightly alkaline fibers are proven to be well mixed in the hammermills and the air-forming distributor with the acid treated fibers prior to the sheet forming.

In one preferred embodiment of the above described method, the fibers are mildly treated with either about 0.2% by weight caustic soda, or just about 1% by weight of house-hold type ammonium-carbonate. Where caustic soda is utilized, the alkali must be diluted in water before application to limit the reaction to the fiber surfaces. The treatment is preferably applied to the fibers in compressed cellulosic pulp before the pulp is disintegrated in a hammermill. Subsequent to this treatment the totally mixed alkali treated and acid treated fibers are for some final products hot well-embossed or calendered. Applying a binder thereafter, but prior to the product being carried through the superheated oven, stabilizes the fiber felt to a form of bond that acts as a bridge between the fibers. It is believed that it is the hot wet-embossing pressure that accelerates the unification process, using the modified binder as a catalyst.

The object of the superheated oven, wherein the boiling and bubbling occurs, is to activate the binder to react with the treated surface of the cellulosic wood fibers, thus saving most of the binder and improving the quality of the final product, since the surfaces of the cellulosic fibers themselves, according to the invention, take part in the binding beyond the hydrogen bond.

According to the present invention, a still further aspect is to increase the bubbling effect in the superheated oven by adding effervescent means to create an extra bubbling effect, for example by adding to the binders 1% by weight sodium-pyrophosphate acid or sodium-bicarbonate. It should be understood that sodium-pyrophosphate acid and sodium bicarbonate are just two examples of effervescent means. An effervescent agent enhances the frequency of the bubbles and the effect of the bubbling, so that the foaming has time to do its job better.

In this regard, yet a further aspect of the present invention resides in adding a small quantity of a gelling, coagulating, agent to the binder solution, such as for instance zinc oxide.

According to the invention a very small amount of about 1% by weight zinc oxide based on the dry substance of the latex might be added.

To delay the bursting of the binder bubbles and delay the collapsing of the binder bubbles, it is advantageous to add a diminutive amount of gelling agent to result in a slight thixotropic quality in the binder agent.

Such a combination of an effervescent agent and a gelling, coagulation agent controls the liveliness of the binder bubbles, for instance in a latex-emulsion, when the emulsion bubbles up in the superheated oven. These reagents can control the duration in which the foam is present thereby ensuring a joint in the fiber-crossings relating to the shrinkage of the binder emulsion and the making of the joint on the loose fiber ends. This forms a three-dimensional network, which includes an establishing and strengthening of the amorphous weak parts of the cellulosic fibers.

As described above, this invention may be used for cellulosic wood fibers, which are hollow and have amorphous weak regions which are to be repaired. The superheated oven can also be used in combination with the effervescent means on cotton-linters or man-made hollow, or not hollow, synthetic fibers, where the fibers are strongly held together by a binder making joints in the fiber-crossings and by said shrinkage of the binder emulsion joining the free ends of the various fibers. Accordingly, it is to be understood that the present invention is not limited to the treatment of cellulosic wood fibers.

The present invention will be illustrated in greater detail by the following specific examples. It should be understood, however, that although these examples may describe in particular detail some of the more specific features of the invention, they are given primarily for purposes of illustration of the invention in its broader aspects and is not to be construed as limited to cellulosic wood fiber absorbent products.

If non-beaten fibers are air-laid in sheet-form, such a fiber product will have practically no tensile strength. The dry strength as well as the wet strength of such a product is zero, or near zero, as is well known to those skilled in the art. Such a sheet-formed fiber product, with no fibrils and no binder applied, made of non-beaten cellulosic wood fibers, is normally of no use for paper products.

If, however, such non-beaten cellulosic wood fibers are air-laid in a sheet-form and a binder such as a latex-emulsion is applied, then a product is produced worldwide is quantities of many thousand tons a year, using previous Kroyer patents and know-how. Such products and their formula are herein regarded as standard examples.

Many thousands of tons of products have been made according to

STANDARD EXAMPLE—EXAMPLE 1

In a standard example, using fibers described above, a latex-emulsion was sprayed onto an air-laid dry-pattern-embossed and absorbent fiber product, having a weight of about 60 grams per square meter.

The latex-emulsion consisting of 15% by weight latex and 85% by weight water, was used in such an amount that 16% by weight latex was contained in the product, before drying with hot air through and along the product took place in a conventional way.

Products made in the above way and having said weight of 60 grams per square meter, have the following characteristics:

Tensile strength: dry—3 inches—1,800 kilos, and
Tensile strength: wet—3 inches—0.975 kilos.

Many thousands of tons of products have been made according to:

STANDARD EXAMPLE—EXAMPLE 2

In another example, using fibers described above, a latex-emulsion was sprayed onto an air-laid dry-pattern-embossed and absorbent fiber product, having a weight of about 100 grams per square meter.

The latex-emulsion, consisting of 15% by weight latex and 85% by weight water, was used in such an amount that 21% by weight latex was contained in the product, before drying with hot air through and along the product took place in a conventional way.

Products made in the above way and having said weight of 100 grams per square meter, have the following characteristics:

Tensile strength: dry—3 inches—4.900 kilos, and
Tensile strength: wet—3 inches—2.900 kilos.

EXAMPLE II ACCORDING TO THE INVENTION

In an example according to the invention and using fibers according to the invention, a latex-emulsion was sprayed onto an air-laid dry-pattern-embossed and absorbent fiber product, producing an absorbent sheet-formed fibrous product compared with the Standard Example 1.

This product, nevertheless, requires only 9% by weight to 10% by weight latex in a 3% by weight to 4% by weight dry substance emulsion, being carried through the superheated oven to boil up the latex-emulsion in the product. The product had the same dry and wet strength as in Standard Example 1:

Tensile strength: dry—3 inches—1.800 kilos, and
Tensile strength: wet—3 inches—0.975 kilos.

EXAMPLE IV ACCORDING TO THE INVENTION

In this example the same procedure as in Example III was utilized for some absorbent products, except that 15% by weight of the quantity of the cellulosic fibers in compressed pulp form were, before the defibration in the hammermill took place, prepared with a aqueous solution of 1.5% by weight ammonium carbonate. To another 15% by weight of the quantity of the fibers, 2% by weight acetic acid was applied. The remaining 70% by weight of the cellulosic fibers in compressed form were not treated, neither with alkali nor with acid.

The result was that the binder required for the dry and wet tensile strength compared with the Standard Example 1, is only 6% by weight instead of 16%, and only 8% by weight instead of 21% by weight in a 3% by weight to 4% by weight dry substance emulsion compared with the Standard Example 2.

EXAMPLE V ACCORDING TO THE INVENTION

Products according to Example IV, but also including zinc oxide in an amount of about ½% by weight, castor oil in an amount of about 1% by weight, ammonium sulphate in a quantity less than 0.01 by weight and an effervescent agent such as 1% by weight sodium-pyrophosphate acid are added to modify the latex. The effect of this procedure according to the invention is that only 3% by weight instead of 16% by weight latex is required to obtain the wet and dry strength as in the Standard Example 1, and only 4% by weight latex instead of 21% by weight latex to meet the wet and dry strength figures in the Standard Example 2.

In this example, latex is reduced by about 80% by weight compared with the Standard Example.

This is one of the advantages of the invention—the saving of production costs for fibrous products.

Regarding the use of the very small amount of ½% by weight of zinc oxide to modify the latex-emulsion:

The zinc oxide has to be dissolved before it is added to the latex-emulsion. This is done by dissolving the zinc oxide in citric acid and adding the dissolved zinc oxide to the latex-emulsion.

EXAMPLE VI ACCORDING TO THE INVENTION

For a washable product such a high wet and dry strength, as mentioned in the Standard Examples 1 and 2 is generally not required. The amount of water-thinned latex binder is therefore further reduced, for inst. to 1% by weight to 2% by weight instead of 16% by weight to 21% by weight based on the total weight of the final product.

It should be noted that not only the fibers are modified, but also the binder is modified. This is what makes it possible to reduce the latex to b 1.5% by weight to 2% by weight instead of 12% to 20%.

In Example V according to the invention, it might be difficult to understand how a quantity of ½% by weight of castor oil mixed into the latex-emulsion can have a very important effect on the final product.

Latex-emulsions are normally delivered from the factories containing about 50% by weight water in the emulsion.

In a preferred embodiment of the invention, the castor oil and a very small portion of the 50% by weight latex-emulsion are vigorously stirred together in a mixer to oxidise the castor oil.

In this way the properties of the castor oil are changed, and it becomes a so-called blown oil. The whipping process is essential and must be carried out little by little.

Following this procedure, the blown castor oil plus a portion of latex-emulsion is gradually mixed with the 50% by weight latex-emulsion. Thereafter, during the continuous stirring, the castor oil latex-emulsion is added so that the final latex-emulsion (to be sprayed on the dry-formed product before the product enters the superheated oven) contains totally 1,2,3 or 4% by weight dry substance.

Since in the process according to the invention the latex-emulsion is very watered down, it is sufficient for most products to be sprayed only on one side with the watered down latex-emulsion, because in the superheated oven the emulsion will bubble-up and be distributed vertically through the whole product. The fiber product will therefore be totally wet when it enters the superheated oven.

While the product is passing through the superheated oven, where there is a temperature of between 200° C. and maybe 350° C., the product itself does not reach this temperature. The high water content in the product means that its temperature will hardly be more than 100° C.

In comparing tensile strength of the above absorbent products, consideration has to be given to the configuration of the embossed patterns and also to the products's percentage of the embossed are as well as to the total bulk of the product. In this regard, in the standard Examples 1 and 2 the thickness was about one millimeter. The embossed area was between 25% and 35%. In all the examples, made in accordance with the invention, the percentages of the embossed area and the nonembossed area as well as the thickness of the final product in the Standard Examples were the same as in the Invention's Examples.

As mentioned before, the superheated oven does not remove a substantial part of water from the product. The main evaporation is left to a traditional dryer.

The bubbling-up effect in the superheated oven has been studied under specially developed three-dimensional microscope equipment. Using this equipment, it was easy to see that when a movement of air occurred through or along the product there was no bubbling-up. On the contrary, the bubbling-up and foaming effect could be seen very clearly if air did not pass through or along the product. The bubbling and foaming up and the bursting of the bubbles are significant for the quality and tensile strength of the final product.

Electronic micro-photography, made in the United States on samples according to the invention, has revaled the structure of the fibrous product, indicating that the acid and alkaline preparation of the cellulosic wood pulp (Kroyerization) plays a higher role in the binding process than traditional binders.

Although not completely understood, it is believed that the much reduced amount of latex polymerizes with the fiber surfaces to make a lasting cross-linking joint, and that when using the described hot wet-embossing, hydrogen bonding "cooporates" with the said polymerization which is very advantageous for special products (see the Kroyer/Torben Rasmussen U.S. Pat. No. 3,669,778).

It has been observed that the acetation and alkalization of the cellulosic fiber surfaces are not only great advantages for absorbent products, but are also great advantages for flat products like writing paper, packaging paper and board etc. etc. For such products, however, it is advantageous to beat the cellulosic fibers before they go into the forming equipment and onto the wire. It should be noted that when the beating of the cellulosic wood fibers takes place, it is very important that they should not be dry during the manufacturing process, that is during the defibration process in the hammermill and during the dry forming process. The Kroyer Hammermills work well with cellulosic pulp which has a water content of up to 30% by weight. That is enough to beat the fibers in the hammermills for production of writing material, packaging material and board etc. etc.

The fibers, which have two different treatments, the acid treatment and the alkaline treatment, can chemically adhere to each other. Such a bond between two different fibers is considered stronger than the normal hydrogen bond, but not as strong as an epoxy resin such as ARALDITE ®. When the surfaces are active, then the adherence can take place. On the other hand, when the product is turned up to a higher temperature, the curing takes place, curing the bond and curing the surface of the fibers so that they are not adhesive anymore. This is done either in the embosser, in the drying oven, during the calendering or during the creping process.

It is interesting to note that no significant effect has been observed when preparing cellulosic wood fibers with the earlier mentioned small amounts of alkali and acid without performing any additional steps of the invention. However, a surprising effect was achieved when using the slightly alkaline-treatment and the slightly acid treatment of the cellulosic wood pulp in combination with the use of the superheated boiling-up oven, that is, the product uses much less binder than conventionally and therefore has, because of less binder content, better absorbency capacity and improved absorbency speed.

In describing the invention, references have been made to preferred embodiments. Those skillful in the art and familiar with the disclosure of the subject invention, however, may recognize additions, deletions, substitutions, modifications and/or other changes which will fall within the purview of the invention as defined by the following claims.

The preparation of the cellulosic wood pulp with water-thinned alkali and acid should be made in such a way that all the fibers in the cellulosic wood pulp become wet. Thereafter the slightly alkalized and acidified pulp should be dryed down to 10, 20, or 30% by weight humidity before the pulp goes into the hammermills. It is the percentage of humidity in the pulp, and the construction of the hammermills which dictate the degree of the beating. If desired, the pulp can pass twice through the hammermill for a higher degree of beating.

In addition to the vast improvements via reduced manufacturing costs, the present invention also contemplates a further embodiment which results in significant environmental savings. First, two portions of wood pulp are respectively treated with an alkali and an acid. The exact amount of alkali and acid varies with temperature and pressures discussed below, but are well below conventional treatments and approximately double the respective amount described above. These two treated portions are then mixed and superheated between, e.g., approximately 150° and 250° C. After drying, the fiber material is pressed at a pressure of, e.g., between 100 and 200 kilos/cm$^2$ by a hydraulic press or, if sufficient pressures may be generated, a roller. If the amount of added alkaline and/or acid is increased, the required pressure will be lower and vice versa. When the alkali is increased according to this embodiment, the acid is also increased such that the final pH of the product is preferably between approximately 4 and 7. The exact amounts of alkaline and acid and the exact pressure and temperature values are the subject of routine experimentation by the skilled artisan based on these teachings.

The described treatment, heating and pressing causes the fibers to be melted together and results in a desirable homogenous sheet having an aperture similar to plastic. However, unlike plastic, the resulting sheet is biodegradable since it primarily wood pulp. The extent of degradability increases as the amount of alkali and acid decreased. In a world of ever diminishing resources and ever growing disposal problems, a homogenous material which is biodegradable serves very definite needs.

In describing the invention, references have been made to preferred embodiments. Those skilled in the art and familiar with the disclosure of the subject invention, however, may recognize additions, deletions, substitutions, modifications and/or other changes which will fall within the purview of the invention as defined by the following claims:

I claim:

1. A method of producing fibrous products from cellulosic wood fiber having a fiber form, said method comprising the steps of:

treating a first portion of the cellulosic wood fiber material with alkali to modify the fiber form of said first portion and form a treated first portion;

treating a second portion of the cellulosic wood fiber material with acid to modify the fiber form of said second portion and form a treated second portion;

mixing said treated first portion and said treated second portion to form a chemically modified fiber material;

depositing a fibrous layer of said chemically modified fiber material on a moving forming wire;

adding a binding agent in an aqueous solution to the fibrous layer; and moving the fibrous layer through an oven;

heated to a temperature above the boiling point of water and where there is substantially no movement of air so as to cause an instantaneous boiling of the water of said aqueous solution and the formation of a foamed binder.

2. The method according to claim 1, wherein said adding step comprises adding an amount of binding agent which is between approximately 2 to 6% by weight of the dried fiber material.

3. The method according to claim 1, wherein the amount of binding agent is between approximately 3 to 4% by weight of the dried fiber material.

4. The method according to claim 1, wherein said temperature is above 200° C.

5. The method according to claim 1, wherein said temperature is above 300° C.

6. The method according to claim 1, further comprising the step of adding a thermoplastic binder powder to the surface of the fiber material before said moving step.

7. The method according to claim 1, wherein the alkali in the treating step is an aqueous solution of 0.2% by weight caustic soda.

8. The method according to claim 1, wherein the alkali in the treating step is an aqueous solution of 1% by weight ammonium carbonate.

9. The method according to claim 1, further comprising the step of adding an effervescent agent to the chemically modified fiber material.

10. The method according to claim 9, wherein the added effervescent agent is an aqueous solution of 1% by weight sodium-pyrophosphate acid.

11. The method according to claim 9, wherein the added effervescent agent is an aqueous solution of 1% by weight sodium bicarbonate.

12. The method according to claim 9, further comprising adding a gelling agent to the chemically modified fiber material.

13. The method according to claim 12, wherein the added gelling agent is 1% by weight zinc oxide.

14. The method according to claim 3, wherein the binding agent is latex.

15. The method according to claim 14, further comprising adding castor oil to the latex.

16. The method according to claim 15, further comprising adding zinc oxide, ammonium sulphate and an effervescent agent to the latex.

17. The method according to claim 16, wherein the effervescent agent is sodium pyrophosphate acid.

18. The method according to claim 15, wherein the castor oil is less than approximately 0.1% by weight of the fiber material.

19. The method according to claim 14, further comprising adding an aqueous solution of approximately 0.01% by weight ammonium sulphate and an effervescent agent to the latex.

20. The method according to claim 19, wherein the effervescent agent is an aqueous solution of approximately 1% by weight sodium pyrophosphate acid.

21. The method according to claim 16, wherein the zinc oxide is dissolved in citric acid prior to its addition to the latex.

22. The method according to claim 15, wherein the latex contains water and further comprising, prior to said adding step, the steps of stirring a portion of the water containing latex with the castor oil to oxidize the castor oil and then adding this stirred castor oil and water containing latex portion to the remainder of the water containing latex.

23. The method according to claim 22, wherein the latex comprises approximately 50% by weight water.

24. The method according to claim 19, wherein zinc oxide is dissolved in an aqueous solution of citric acid prior to its addition to the latex.

25. The method according to claim 1, further comprising adding approximately 1 to 2% by weight of a latex binder to the fiber material.

26. The method according to claim 1, wherein said mixing step occurs in a single hammermill.

27. The method according to claim 1, wherein said mixing step comprises mixing the treated portions together with an untreated portion of cellulosic wood fiber material.

28. The method according to claim 14, wherein water is added to the latex binding agent prior to said adding step such that the dry latex portion comprises between approximately 2 to 5% by weight of the resulting latex and water mixture.

29. The method according to claim 1, further comprising pressing the chemically modified fiber material.

* * * * *